US010485274B2

(12) United States Patent
Allen

(10) Patent No.: US 10,485,274 B2
(45) Date of Patent: Nov. 26, 2019

(54) VERTICAL LIFT HARNESS AND TURNOUT GEAR

(71) Applicant: Douglas L. Allen, Weehawken, NJ (US)

(72) Inventor: Douglas L. Allen, Weehawken, NJ (US)

( * ) Notice: Subject to any disclaimer, the term of this patent is extended or adjusted under 35 U.S.C. 154(b) by 629 days.

(21) Appl. No.: 15/092,135

(22) Filed: Apr. 6, 2016

(65) Prior Publication Data

US 2017/0290379 A1 Oct. 12, 2017

(51) Int. Cl.

| | |
|---|---|
| ***A41D 13/00*** | (2006.01) |
| ***A41D 13/02*** | (2006.01) |
| ***A62B 35/00*** | (2006.01) |
| ***A62B 17/00*** | (2006.01) |

(52) U.S. Cl.

CPC ..... *A41D 13/0007* (2013.01); *A41D 13/02* (2013.01); *A62B 17/003* (2013.01); *A62B 35/0018* (2013.01)

(58) Field of Classification Search

CPC ..... A41D 13/0007; A41D 13/02; A41D 1/02; A41D 13/0012; A41D 31/0022; A41D 27/02; A41D 27/04; A62B 17/003; A62B 35/00; A62B 35/0018; A62B 35/0037; A62B 35/005; A62B 35/0006; A62B 35/0012; A62B 35/0043

USPC ..... 2/94, 97

See application file for complete search history.

(56) References Cited

U.S. PATENT DOCUMENTS

| | | | | |
|---|---|---|---|---|
| 1,172,615 A | | 2/1916 | Lelansky | |
| 1,183,511 A | | 5/1916 | Adams | |
| 2,979,153 A | | 4/1961 | Hoagland et al. | |
| 3,176,793 A | | 4/1965 | Robert | |
| 3,498,408 A | | 3/1970 | Foote | |
| 3,973,643 A | | 8/1976 | Hutchinson | |
| 4,449,253 A | | 5/1984 | Hettinger | |
| 4,625,335 A | | 12/1986 | Vinai | |
| 5,036,548 A | | 8/1991 | Grilliot | |
| 5,095,549 A | | 3/1992 | Aldridge | |
| 5,136,724 A | * | 8/1992 | Grilliot | A62B 17/003 182/3 |
| 5,188,267 A | | 2/1993 | Sargent et al. | |
| 5,267,352 A | | 12/1993 | Rodarmel | |
| 5,289,590 A | | 3/1994 | Larson | |
| 5,450,627 A | | 9/1995 | Grilliot | |
| 5,548,843 A | | 8/1996 | Chase et al. | |
| 5,738,046 A | | 4/1998 | Williams | |

(Continued)

OTHER PUBLICATIONS

International Search Report and Written Opinion from PCT/US2017/026065, dated Jul. 26, 2017.

*Primary Examiner* — Amy Vanatta

(74) *Attorney, Agent, or Firm* — Charney IP Law LLC

(57) ABSTRACT

A safety harness for vertically lifting of a user is provided. The safety harness includes an upper body harness and a lower body harness which may be positioned on liners within a coat and pants of the user, respectively. The upper body harness and lower body harness attach together to function as a Class III harness enabling lifting of a user in a vertical orientation by virtue of the harness geometry. The lower body harness alone serves as a Class II harness and the upper body harness alone serves as a drag line. The harness is particularly suited to be integrated with firefighting turn-out gear for ready donning with the turnout gear.

21 Claims, 7 Drawing Sheets

(56) References Cited

U.S. PATENT DOCUMENTS

| | | | | |
|---|---|---|---|---|
| 5,884,332 | A | 3/1999 | Snedeker | |
| 5,970,517 | A | 10/1999 | Jordan | |
| 6,035,440 | A * | 3/2000 | Woodyard | A41D 13/0007 182/3 |
| 6,101,631 | A | 8/2000 | Ferguson, Jr. | |
| 6,105,169 | A * | 8/2000 | Colorado | A62B 35/0025 182/6 |
| 6,637,547 | B1 | 10/2003 | Wydner | |
| 6,658,666 | B2 | 12/2003 | Schweer | |
| 7,047,567 | B2 | 5/2006 | Allen | |
| 8,776,266 | B1 * | 7/2014 | Metz | A41D 13/0007 2/93 |
| 2002/0042942 | A1 | 4/2002 | Colorado | |
| 2003/0172431 | A1 | 9/2003 | Allen | |
| 2004/0163156 | A1 | 8/2004 | Schweer | |
| 2005/0278819 | A1 * | 12/2005 | Munn | A41D 13/0007 2/69 |
| 2006/0005293 | A1 | 1/2006 | Frey | |
| 2007/0204377 | A1 * | 9/2007 | Mordecai | A41D 13/0007 2/69 |
| 2008/0164095 | A1 * | 7/2008 | Snedeker | A41D 13/0007 182/3 |
| 2009/0127396 | A1 | 5/2009 | Jordan | |
| 2009/0236176 | A1 * | 9/2009 | Sheu | A41D 13/0007 182/3 |
| 2009/0320188 | A1 * | 12/2009 | Johnson | A62B 35/0018 2/455 |
| 2010/0011490 | A1 | 1/2010 | Stinson | |
| 2011/0030119 | A1 | 2/2011 | Fee | |
| 2011/0214212 | A1 * | 9/2011 | Marx | A41D 13/0007 2/2.5 |
| 2012/0055737 | A1 | 3/2012 | Helms | |

* cited by examiner

VERTICAL LIFT HARNESS AND TURNOUT GEAR

BACKGROUND OF THE INVENTION

The present invention relates safety harnesses, and in particular, safety harnesses for use with a firefighter's turnout coat and bunker pants.

Firefighters typically wear protective clothing comprising a lined turnout coat and lined bunker pants, often referred to collectively as turnout gear. Such clothing is made of fire retardant and protective material, and is designed to ensure the safety of the firefighter.

Firefighters also use equipment such as a safety harness. Typical safety harnesses come in either the Class II or Class III variety, Class II harnesses being used when there are only limited fall hazards while Class III harnesses are designed to arrest the most severe free falls. The vast majority of these harnesses are worn externally.

Applicant's U.S. Pat. No. 7,047,567 provides one elegant solution to mitigate some of the drawbacks of an external harness. As taught in the '567 Patent, the disclosure of which is hereby incorporated by reference herein, a safety harness is combined with turnout gear to provide an internal safety harness, sandwiched securely between the liner and outer shell (jacket and pants) of the turnout gear. This arrangement is desirable because what would conventionally be installed external to the turnout gear could now be installed internally. Another benefit is that the internal harness is donned automatically with the turnout gear, thus being quickly and easily worn by a firefighter in the emergency situations typical in the firefighting field, ensuring that a firefighter would always be totally prepared with a safety harness on his or her everyday turnout gear. Another advantage is increased durability and security of the harness since a majority of the harness is hidden and protected by the outer gear and not exposed to potential objects that could interfere with the harness or the free movement of the firefighter, or which could damage the harness over time. Nor is the majority of the harness exposed to hostile environments.

Despite the advances of the '567 patent, many firefighters still rely on the traditional Class II harness worn externally even if it does not offer the best level of protection available (versus, for example, severe fall risks), is difficult to wear, and catches on objects in the firefighting arena. While some firefighters do wear Class III harnesses, most do not despite their clear safety advantage.

The present disclosure provides for a harness system with qualities that far surpass the Class II and even the Class III conventional harnesses while also building on the teachings of the '567 patent to provide additional improvements.

SUMMARY OF THE INVENTION

One of the disadvantages of conventional Class III harnesses is that they lift the user in a non-vertical orientation, generally 30-45 degrees off vertical. In the realm of firefighting, this can be problematic when a disabled firefighter is being extracted from a dangerous scene. Consider, for example, a situation where a firefighter falls through a compromised structure. Often, the firefighter will have to be extracted from the structure through his/her entry hole. If the firefighter is lifted in an orientation other than vertically, the procedure becomes more difficult as the structure's hole is often no bigger than the firefighter's width. Addition issues arise in confined space scenarios where a firefighter may have to be lifted through a small entryway, such as a hatch.

One of the primary improvements provided by the inventive harness is the ability to lift the user in a vertical orientation.

Another benefit of the inventive harness is the ability to connect another individual for vertical lifting or descending. Vertical lifting or descending in this situation would occur whether the second individual was conscious or unconscious, injured or well, provided that they too are wearing this inventive harness.

Finally, a third benefit of the present invention is the capacity to integrate a drag line into the harness, further protecting the wellbeing of the firefighter.

Additional benefits will be understood when considering the following disclosure.

In accordance with an embodiment of the present invention, a safety harness for vertical lifting of a user may include an upper body harness having a horizontal strap adapted to extend around the torso of a user such that a rear portion of the horizontal strap is fitted at the back of the user and a front portion of the horizontal strap is fitted at the front of the user with respective left and right side portions fitted at the user's left and right sides; a first vertical strap extending from the rear portion of the horizontal strap toward a first shoulder of the user; a second vertical strap extending from the rear portion of the horizontal strap toward a second shoulder of the user; a drag line support strap extending from the left side portion to the right side portion along the back of the user; a drag line having a first end associated with the drag line support and a free second end; and a lower body harness connected to the upper body harness at the left and right side portions; wherein vertical lifting of the drag line free end pulls the drag line support strap upward toward the neck of a user to engage the lower body harness and place the user in a vertical orientation.

The first vertical strap and the second vertical strap may cross each other in the back area of the user and the drag line support strap may be positioned between the first vertical strap and the second vertical strap in the back area. The first end of the drag line may be free to move along at least a portion of the drag line support strap.

A lower body harness may be connected to the upper body harness by removable connections. The upper body harness alone may act as a drag line harness, the lower body harness alone may act as a Class II harness, and the upper body harness and the lower body harness together may act as a Class III harness.

The safety harness may include a firefighter turnout coat and pants, wherein the safety harness is integral to the turnout coat and pants. The turnout coat and pants may include a turnout coat liner and bunker pants liner, wherein a majority of the upper body harness is positioned between the turnout coat liner and the turnout coat and a majority of the lower body harness is positioned between the bunker pants liner and the bunker pants. The upper body harness may be removeably attached to the turnout coat liner in a plurality of locations and the lower body safety harness may be removeably attached to the bunker pants liner in a plurality of locations.

The safety harness may include a firefighter turnout coat and pants, wherein the safety harness is integral to the turnout coat and pants and the turnout coat and pants may include a turnout coat liner and bunker pants liner, wherein a majority of the upper body harness is positioned between the turnout coat liner and the turnout coat and a majority of the lower body harness is positioned between the bunker pants liner and the bunker pants. The turnout coat liner may then include first and second slots to permit portions of the upper body harness to extend there through, the bunker pants then including third and fourth slots to permit portions of the lower body harness to extend there through, and the turnout coat then including a fifth slot to permit portions of the drag line to extend there through. The portion of the upper body harness extending through the first and second slots may include portions connected to the lower body harness, and the connections may be detachable connections.

The lower body harness may include a belt with a buckle and a D-ring, wherein the buckle is positioned toward either the right or the left side of a user and the D-ring is positioned along the vertical centerline of the user.

In accordance with a further embodiment of the invention, firefighter turnout gear with safety harness comprises a coat and coat liner, the coat liner positioned inside the coat; pants and pants liner, the pants liner positioned inside the pants; an upper body harness positioned primarily between the coat and coat liner; a lower body harness positioned primarily between the pants and pants liner; wherein the coat liner includes a first slot and second slot through which a portion of the upper body harness extends for connection with the lower body harness.

The upper body harness and the lower body harness may be connected together, and the upper body harness may further include a horizontal strap positioned at least in a rear portion of the coat liner; a first vertical strap extending from the horizontal strap toward a first shoulder of the coat liner; a second vertical strap extending from the horizontal strap toward a second shoulder of the coat liner; a drag line support strap having a first end and a second end, each of the ends connected to the horizontal strap, the drag line support strap positioned between the coat liner and the first and second vertical straps; and, a drag line having a first end associated, with the drag line support and a free second end; wherein vertical lifting of the drag line free end pulls the drag line support strap upward toward the neck of the coat liner and engages the lower harness to place the user in a vertical orientation.

The upper body harness and the lower body harness may be retrofitted into existing coat and pants by forming the first slot and the second slot and extending portions of the upper body harness there through.

The lower body harness may include a belt and the pants may include third and fourth slots, portions of the belt extending through the third and fourth slots. In such case, the upper body harness and the lower body harness may be retrofitted into existing coat and pants by forming the first slot and the second slot and extending portions of the upper body harness there through and forming the third slot and the forth slot and extending portions of the belt there through.

The lower body harness may include a belt with a buckle and a D-ring, wherein the buckle is positioned toward either a side of the pants and the D-ring is positioned along the vertical centerline of the coat and pants.

The upper body harness alone may act as a drag line harness, the lower body harness alone may act as a Class II harness, and the upper body harness and the lower body harness together may act as a Class III harness.

In another embodiment of the present invention, a method of retrofitting a coat, coat liner, pants, and pants liner, to incorporate a safety harness, includes forming a first slot and a second slot in the coat liner; forming a third slot and a fourth slot in the pants; fitting an upper body portion of the safety harness to the outside of the coat liner; threading portions of the upper body safety harness through the first slot and the second slot to position the portions on the inside of the coat liner; fitting a lower body portion of the safety harness to the outside of the pants liner.

The method may further include forming a fifth slot in the coat; installing the coat liner and upper body portion of the safety harness into the coat; threading a portion of the upper body safety harness through the fifth slot to position the portion on the outside of the coat; installing the lower body portion of the safety harness and pants liner into the pants; and threading portions of a belt of the lower body harness through the third slot and the fourth slot to expose the portions of the belt threaded there through.

BRIEF DESCRIPTION OF THE DRAWINGS

The subject matter regarded as the invention is particularly pointed out and distinctly claimed in the concluding portion of the specification. The invention, however, both as to organization and method of operation, together with features, objects, and advantages thereof, will be or become apparent to one with skill in the art upon reference to the following detailed description when read with the accompanying drawings. It is intended that any additional organizations, methods of operation, features, objects or advantages ascertained by one skilled in the art be included within this description, be within the scope of the present invention, and be protected by the accompanying claims.

With respect to the drawings.

DETAILED DESCRIPTION

Figure 1A:
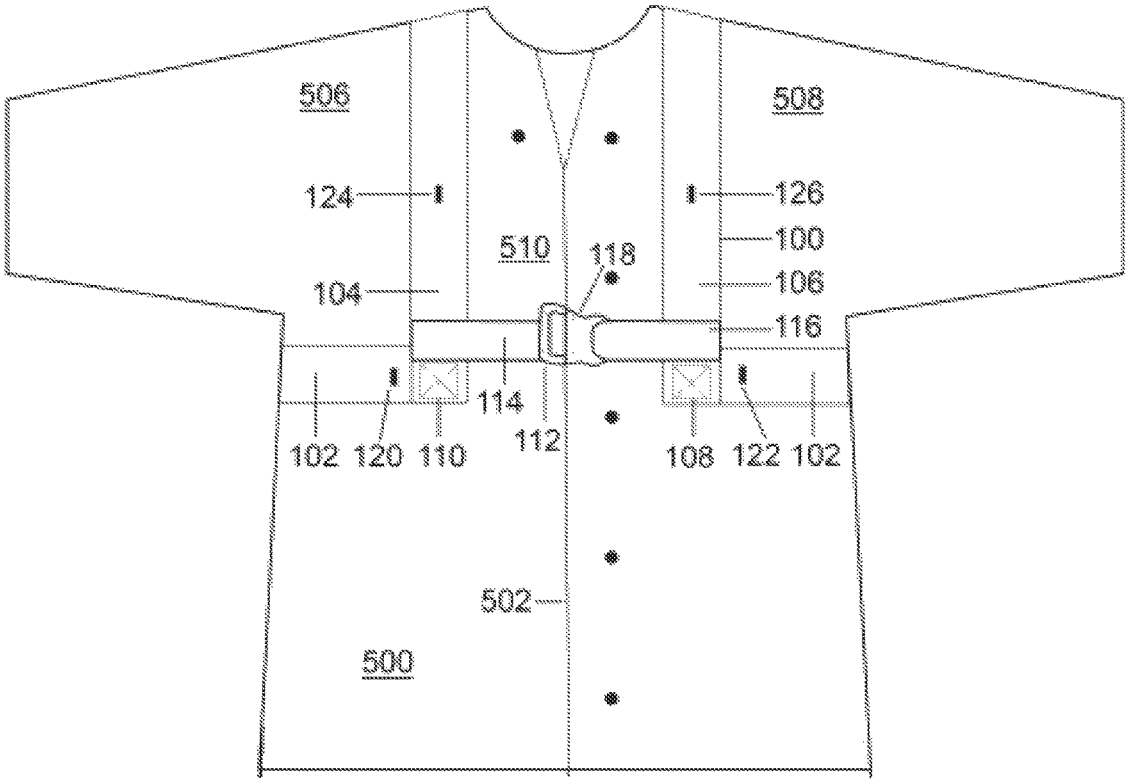
FIGS. 1A and 1B are frontal views of the preferred embodiment of the inventive vertical lift harness installed on the outer surface of the liner of a firefighter's turnout gear, FIG. 1A depicting the upper portion and FIG. 1B depicting the lower portion.

In the following are described the preferred embodiments of the VERTICAL LIFT HARNESS of the present invention. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose. Where like elements have been depicted in multiple embodiments, identical reference numerals have been used in the multiple embodiments for ease of understanding.

Prior to discussing the specific drawings, it is noted that this disclosure will reference several articles which are important for an understanding of the disclosure, the first article being the inventive harness, hereinafter referred to as harness H, which consists of a upper body harness 100 and a lower body harness 200. Other articles that will be referenced are a firefighter's turnout coat 300 and bunker pants 400, as well as the turnout coat liner 500 and bunker pants liner 600.

The materials used to construct the harness are generally the same as those utilized for conventional Class III harnesses manufactured for severe service such as firefighting, including straps formed from materials such as Kevlar® webbing secured together with threading consistent with Class III construction. Kevlar® is a trademark of E.I. DuPont de Nemours and Company. Fittings are typically constructed from metals such as zinc plated steel, high strength aluminum, titanium, or the like. All materials are to be chosen for use in high temperature environments and shall be designed for the working loads necessary to ensure safety per applicable regulatory standards.

Figure 1B:
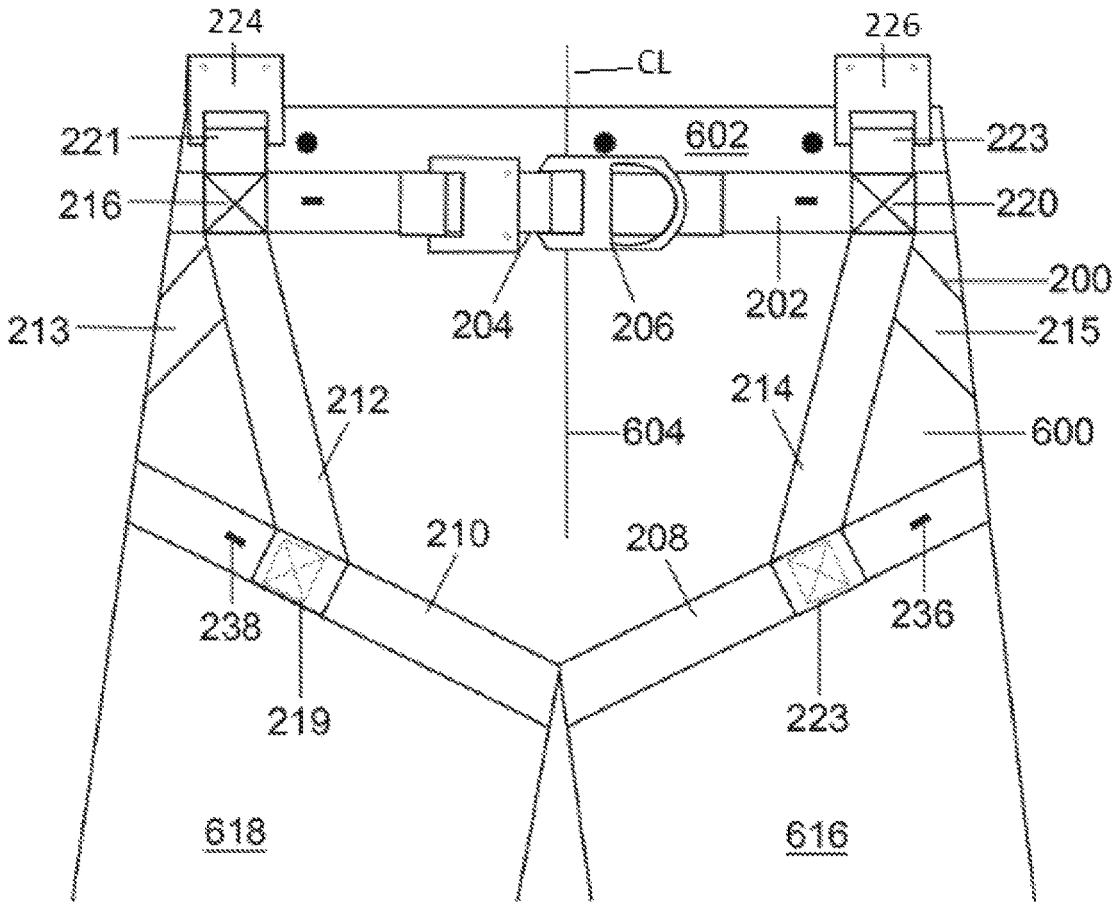

FIGS. 1A and 1B depict a frontal view of the preferred embodiment of the inventive vertical lift harness H installed on a firefighter's turnout coat liner 500 (FIG. 1A) and a firefighter's bunker pants liner 600 (FIG. 1B). Focusing first on the upper body harness 100 fitted to the turnout coat liner 500 and upper body of a user, shown in FIG. 1A, it is seen that the upper body harness includes a horizontal strap 102 and two vertical straps 104, 106. The horizontal strap 102 begins at a first connection point 108 offset from the closure 502 of the turnout coat liner 500 and extends around the back 504 of the turnout coat liner (see FIG. 2A) to a second connection point 110 oh the opposite side of the closure.

The first vertical strap 104 begins at the second connection point 110 and extends vertically over the right shoulder area 506 of the turnout coat liner 500 toward the back 504 of the turnout coat liner. Meanwhile, the second vertical strap 106 begins at the first connection point 108 and extends vertically over the left shoulder area 508 of the turnout coat liner 500 toward the back 504 of the turnout coat liner. As will be seen, the first vertical strap 104 and second vertical strap 106 cross in the back 504 of the turnout coat liner.

The first vertical strap 104 and horizontal strap 102 are connected to each other at the second connection point 110 in a secure manner, preferably with boxed and crossed stitching. The second connection point 110 is not itself permanently connected to the turnout coat liner 500. Likewise, the second vertical strap 106 and horizontal strap 102 are connected to each other at the first connection point 108 in a secure manner, preferably with boxed and crossed stitching. The first connection point 108 is not itself permanently connected to the turnout coat liner 500.

Extending between the first vertical strap 104 and the second vertical strap 106, at approximately the mid-chest level 510 of a user, is a securing strap 112. The securing strap 112 consists of a first securing strap 114 and a second securing strap 116 which may be connected to each other with a chest buckle 118. It will be appreciated that the chest buckle 118 comprises suitable high strength components for this application, typically with a male component secured to either the first securing strap 114 or the second securing strap 116 and a female component secured to the other, where the male and female components may be connected and disconnected in use. The first securing strap 114 is sewn to the first vertical strap 104 and the second securing strap 116 is sewn to the second vertical strap 106 at their respective ends opposite the chest buckle 118.

To secure the upper body harness 100 to the turnout coat liner 500, there are provided several "removable attachment points." These points are locations where the upper body harness 100 is attached, in a relatively small area to the turnout coat liner 500. Preferably this removable attaching is achieved with corresponding hook and loop type fasteners such that a user can readily attach and detach the upper body harness 100 to or from the turnout coat liner 500. Suitable hook and loop type fasteners include Velcro® fasteners. Velcro® is a registered trademark of Velcro Industries B.V., Castorweg 22-24, Curacao, Netherlands. This ability to remove the harness from the turnout gear is preferred both for cleaning purposes and for purposes of inspecting the harness and turnout gear periodically. Areas of the upper body harness 100 directly adjacent to or remote from the removable attachment points are therefore not connected to the turnout coat liner 500 and are free to move with respect thereto. With these removable attachment points, the upper body harness 100 is affixed to the turnout coat liner 500 such that upon donning of the turnout coat liner (and affixing the harness buckles as will be discussed), a firefighter automatically is wearing proper harness protection.

A removable attachment point 120 is located in the horizontal strap 102 adjacent to the second connection point 110, and toward the back 504 of the user. A removable attachment point 122 is located in the horizontal strap 102 adjacent to the first connection point 108, and toward the back 504 of the user.

The first vertical strap 104 includes a removable attachment point 124 approximately midway between the right shoulder area 506 and the second connection point 110 while the second vertical strap 106 includes a removable attachment point 126 approximately midway between the left shoulder area 508 and the first connection point 108. These removable attachment points, and any other mentioned, are merely suggestions on where such points may be located. Other locations, additional locations, or fewer locations, are also conceivable.

Figure 2A:
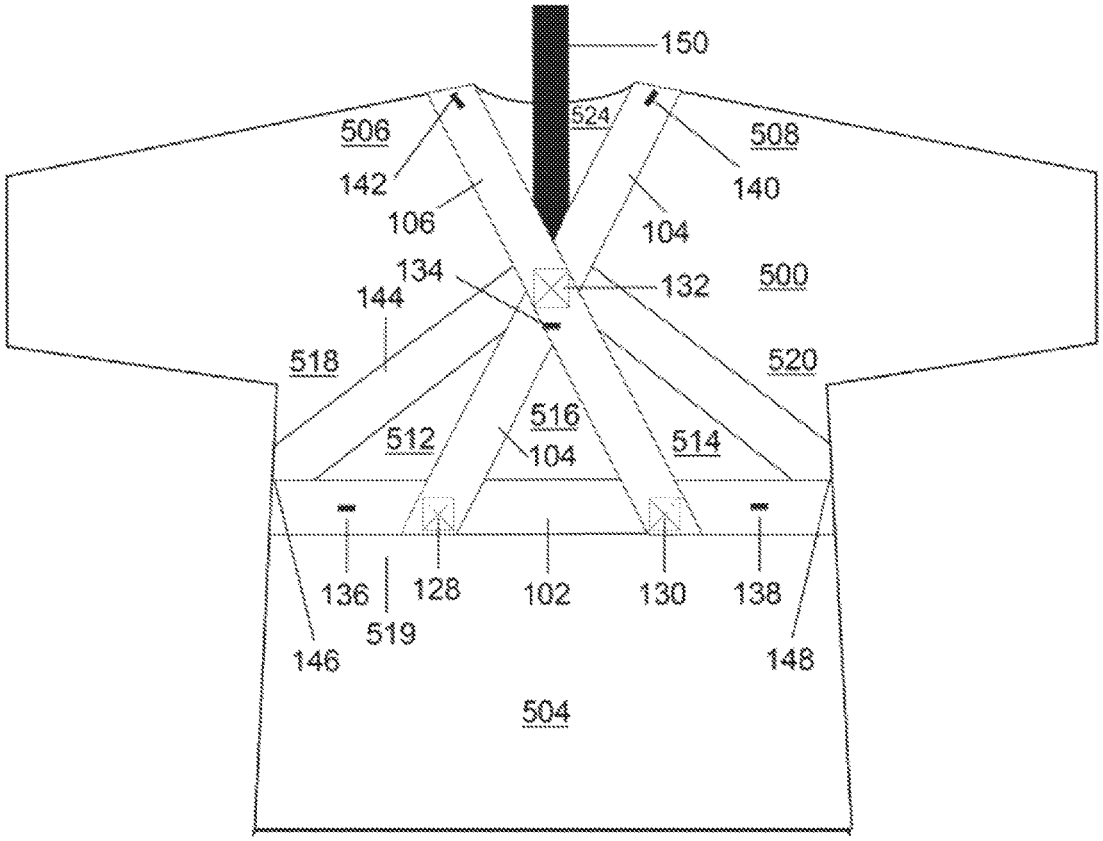
FIGS. 2A and 2B are rear views of the vertical lift harness and turnout gear liners of FIGS. 1A and 1B.
Figure 2B:
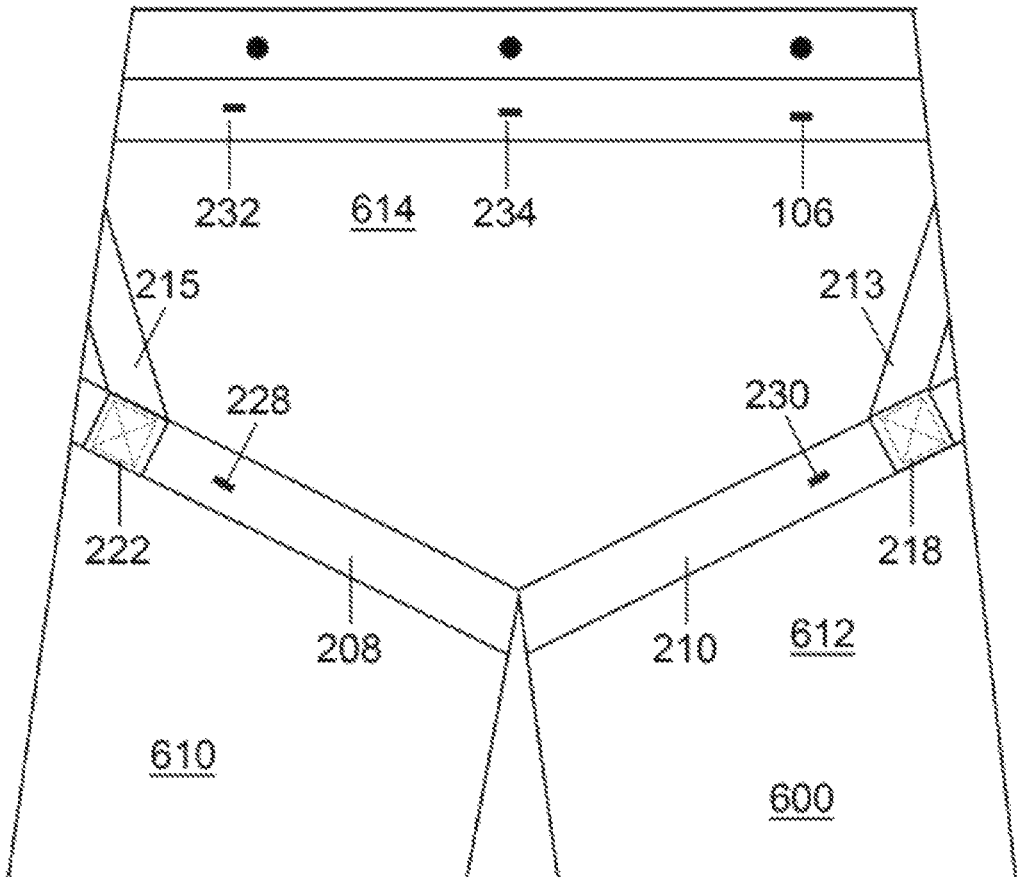

FIGS. 2A and 2B depict a rear view of the preferred embodiment of the inventive vertical lift harness H installed on a firefighter's turnout coat liner 500 and a firefighter's bunker pants liner 600. Referring primarily to FIG. 2A, it will be appreciated that the horizontal strap 102 extends around the back 504 of the turnout coat liner 500 in a continuous length such that the entirety of the horizontal strap is continuous from the first connection point 108 to the second connection point 110. It will also be appreciated that the first vertical strap 104 extends over the right shoulder 508 of the user and then angles downward toward the left kidney area 512 where it terminates with a third connection point 128, again connecting the first vertical strap to the horizontal strap 102. In the meantime, the second vertical strap 106 extends over the left shoulder 506 of the user and then angles downward toward the right kidney area 514 where it terminates with a fourth connection point 130, again connecting the second vertical strap to the horizontal strap 102. In the mid-back area 516, the first vertical strap 104 and second vertical strap 106 cross each other at a fifth connection point 132.

As with the prior connection points, the third connection point 128, fourth connection point 130, and fifth connection point 132 are preferably made with boxed and crossed stitching to connect the respective straps.

Directly adjacent, and below, the fifth connection point, both the first vertical strap 104 and second vertical strap 106 are removeably connected to the turnout coat liner 500 with a removable attachment point 134. Additional removable attachment points 136, 138 are provided in the left and right kidney areas 512, 514 to secure the horizontal strap 102 to the turnout coat liner. Lastly, removable attachment points 140, 142 are provided in the left and right shoulder area 506, 508 to removeably connect the first vertical strap 104 and second vertical strap 106 to the turnout coat liner 500.

A drag line support strap 144 is provided across the back 504 of the turnout coat liner 500. The drag line support strap 144 begins at a sixth connection point 146 where it connects with the horizontal strap 102 beneath the left arm pit 518 of the user generally toward the mid back/chest region 519.

The drag line support strap 144 ends at a seventh connection point 148 where it connects with the horizontal strap 102 under the right arm pit 520, again generally toward the mid back/chest region 510 of the user. Between the sixth connection point 146 and seventh connection point 148, the drag line support strap 144 passes under both the first vertical strap 104 and second vertical strap 106, preferably just above the removable attachment point 134 and directly below the fifth connection point 132. Extending from the drag line support strap 144 is a drag line 150. The drag line 150 is typically not connected directly to the drag line support strap 144 but rather is looped around the drag line support strap and then sewn to itself. Thus, the drag line 150 may move relatively freely along the length of the drag line support strap 144. Although not shown, an additional strap may be positioned between vertical strap 104 and vertical strap 106, above fifth connection point 132, where the strap is inclusive of a slit through which drag line 150 may thread to further prevent the drag line 150 from wandering outside or within the shoulders 506, 508 of the user.

Finally, as shown best in FIG. 3, the upper body harness 100 further includes the first halves 121, 123, FIG. 5, of a pair of buckles 224, 226, FIG. 3, adapted to connect the upper body harness to the lower body harness 200, FIG. 1B, as will be described. Those buckle halves 121, 123 are connected to the sixth connection point 146 and seventh connection point 148, respectively, with webbing 125, 127, FIG. 3, threaded through slots 526, 528, FIG. 3, in the turnout coat liner 500 such that the buckle halves 121, 123, are provided on the inside of the turnout coat liner.

Moving specifically to FIGS. 1B and 2B, there is shown a lower body harness 200 and its relation to the turnout pants liner 600. The lower body harness 200 includes a belt 202 extending around the waist 602 of a user. The belt 202 begins and ends with a buckle 204, preferably oriented in an offset location from the "fly" area 604 of the user. This offset permits a D-ring 206, through which the belt 202 is threaded, to be located directly at the "fly" area 604 of the user, along the vertical centerline CL of a user, the vertical centerline extending vertically from the top of the head, through the navel, and to the point where the feet meet while standing (additionally, a coat and pants have the same vertical centerline without the user). This orientation permits the user to be lifted by the D-ring 206 with the D-ring directly in-line with the user's vertical orientation. This orientation also permits the D-ring 206 to be placed to the side of the buckle 204 such that when a user is in need of opening the buckle, for example to remove his bunker pants 400, the D-ring 206 is not directly over the buckle as it is in so much of the prior art, which requires the D-ring to be removed prior to unbuckling the bunker pants. This makes removal of the bunker pants 400 much easier. Additionally, a descending device (such as a carabiner and rope, neither shown) can remain hooked up to the D-ring 206 at all times, with the rope being placed in a pocket 401, FIG. 3, on the left thigh of a user. With this arrangement, unbuckling of the buckle 204 may be achieved with the descending device still attached. The D-ring 206 will move toward the left thigh of the user, along with the pocket 401. FIG. 3, and will therefore remain always ready for the next deployment.

Wrapped around the left leg 616 and right leg 618 of the bunker pants liner 600 are leg loops 208, 210. Each of the leg loops 208, 210 is constructed of a webbing material looped and sewn to itself in a secure manner. The leg loops 208, 210 are connected to the belt 202 with four vertical connector members, a front right vertical connector member 212, a front left vertical connector member 214, a rear right vertical connector member 213, and a rear left vertical connector member 215. The front right vertical connector member 212 and rear right vertical connector member 213 are both secured to the belt 202 at an eighth connection point 216, with the rear right vertical connector member connected to the right leg loop 210 at a ninth connection point 218 and the front right vertical connector member connected to the right leg loop 210 at a twelfth connection point 219. The front left vertical connection member 214 and the rear left vertical connection member 215 are both secured to the belt 202 at a tenth connection point 220 and the rear left vertical attachment member is connected to the left leg loop 208 at an eleventh connection point 222 with the front left vertical attachment member 214 connected to the left leg loop at a thirteenth attachment point 223. As before, the connection points are made with boxed and crossed stitching, or other stitch patterns appropriate for the stresses placed on the components per applicable standards.

Also provided at the eighth connection point 216 and tenth connection point 220 are the other halves 225, 227 of the pair of buckles 224, 226, previously discussed. It will be appreciated that the buckle halves 225, 227 are fitted to webbing 221, 223 (see FIG. 3) for connection to the eighth connection point 216 and tenth connection point 220, respectively. The buckles 224, 226 may be connected or disconnected, where disconnection, "detachment," or "removal," permits separation of the upper body harness 100 from the lower body harness 200 and connection connects the upper body harness to the lower body harness.

Removable attachment points are provided in various locations to removeably secure the lower body harness 200 to the bunker pants liner 600. For example, a removable attachment point 228 is provided to secure the left leg loop 208 to the bunker pants liner in the area of the lower left buttocks 610 while removable attachment point 230 is provided to secure the right leg loop 210 to the bunker pants liner in the area of the lower right buttocks 612. Connecting the belt 202 to the bunker pants liner are a pair of removable attachment points 232, 234 located generally in the area of the small of the back 614. Additional removeable attachment points 236, 238 are provided in the left thigh area 616 and right thigh area 618, respectively. Finally, the belt 202 is also removeably attached to the bunker pants liner 600 at a removable attachment point 240 between the buckle 204 and eighth connection point 216 and removable attachment point 242 between the D-ring 206 and the tenth connection point 220. As before, these removable attachment points are preferably formed with corresponding hook and loop type fasteners and there may be more or less removable attachment points than discussed herein.

Figure 3:
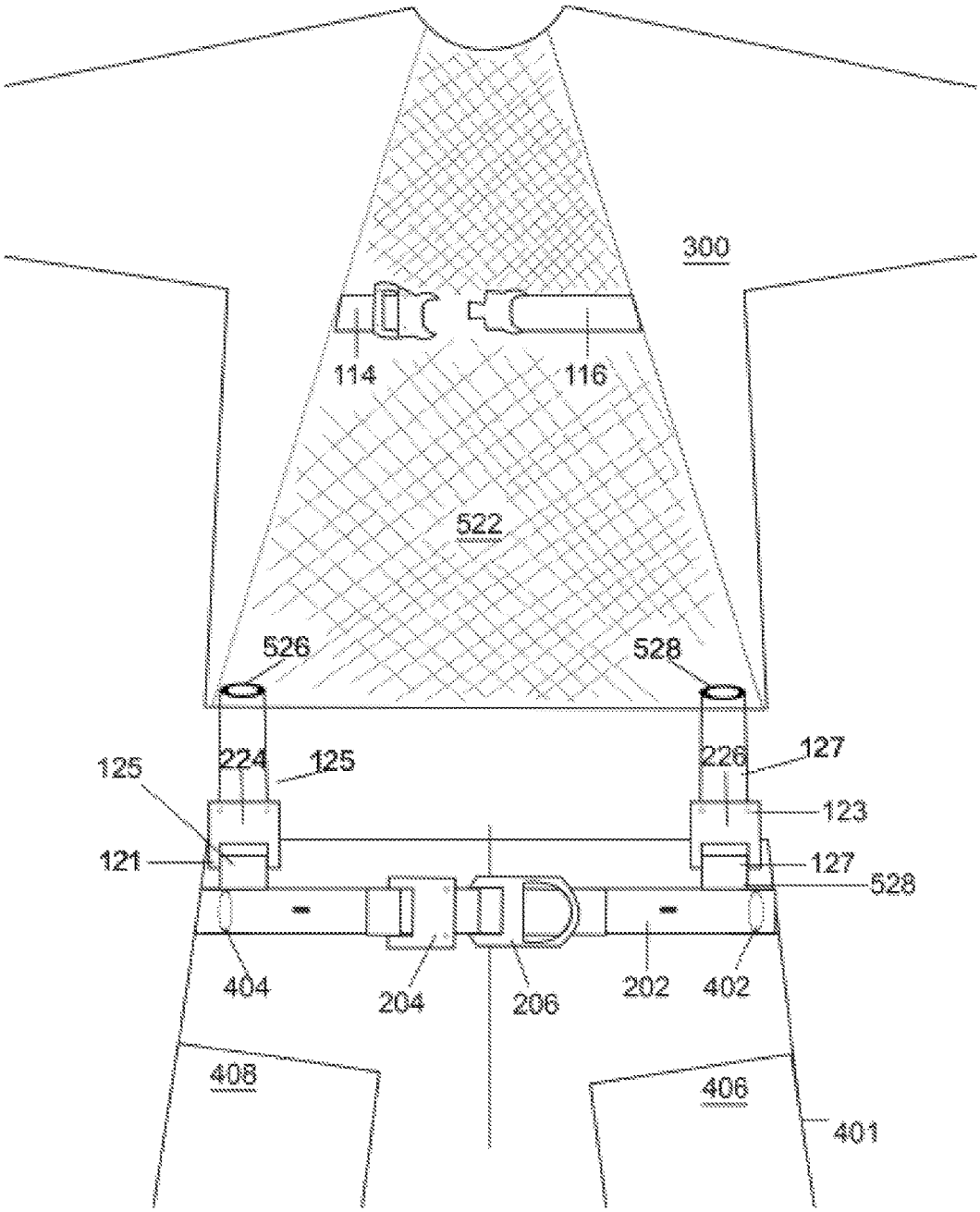
FIG. 3 depicts a frontal view of firefighter turnout gear with the preferred embodiment of the inventive harness installed.

FIG. 3 depicts a frontal view of firefighter turnout gear with the preferred embodiment of the inventive harness installed. Specifically, one can see the inside 522 of the turnout coat liner 500 installed in a turnout coat 300 together with an outside view of bunker pants 400.

It will be appreciated that bunker pants 400 include a pair of slots 402, 404 provided at the left and right hips 406, 408, respectively. The slots 402, 404 are sized just larger than the width of belt 202 so buckle 204 and D-ring 206 of the belt can be brought from within the bunker pants 400 to outside the bunker pants for fastening by the user. The remainder of the lower body harness 200 remains hidden between the bunker pants liner 600 and the bunker pants 400. In this regard, the chances of hooking the harness 200 unexpectedly against an object is virtually eliminated.

First securing strap 114 and second securing strap 116 are shown protruding from between the turnout coat liner 500 and the turnout coat 300 such that chest buckle 118 may be secured upon donning of the turnout gear. It will be appreciated there here, there are no slits required in the turnout coat liner.

It is to be understood that the drag line 150 is to extend through the turnout coat 300 through a slot formed through the turnout coat in back neck area of a user, between the right shoulder area 506 and the left shoulder area 508. This prevents the drag line 150 from interfering with the breathing apparatus, helmet, or other essentials of firefighting. The drag line 150 may then be advanced over either of the shoulders of the user and connected to the front of either shoulder or breast area with corresponding hook and loop type fasteners. Thus the drag line 150 is always available at the front a user for his use or use by others in an emergency situation. The end of the drag line 150 connected to the front of the user may be provided with a hand loop for further use. In other arrangements, the drag line may simply stop at the upper shoulder area and not continue toward the front of the user. If it does continue, it may be covered by a fire retardant flap or otherwise protected by fire retardant material.

The aforementioned turnout gear and liners, namely bunker pants 200, turnout coat 300, turnout coat liners 500, and bunker pants liner 600 may be manufactured as shown and described above. That is, they may include the various slots 402, 404 of the bunker pants 400, slots 526, 528 of the turnout coat liner 500, and the slot in the turnout coat 300 for the drag line 150, direct from the factory such that a harness H may be provided with the turnout gear from the factory. In such case, the removable attachment points are also to be provided directly from the factory.

Alternatively, the turnout gear, including bunker pants 200, turnout coat 300, turnout coat liner 500, and bunker pants liner 600 may be conventional turnout gear retrofitted for use with the harness H. In this regard, slots 402, 404 of the bunker pants 400, slots 526, 523 of the turnout coat liner 500, and the slot in the turnout coat 300 for the drag line 150 will be cut into the bunker pants, turnout coat liner, and turnout coat for installation of the harness H.

Figure 4:
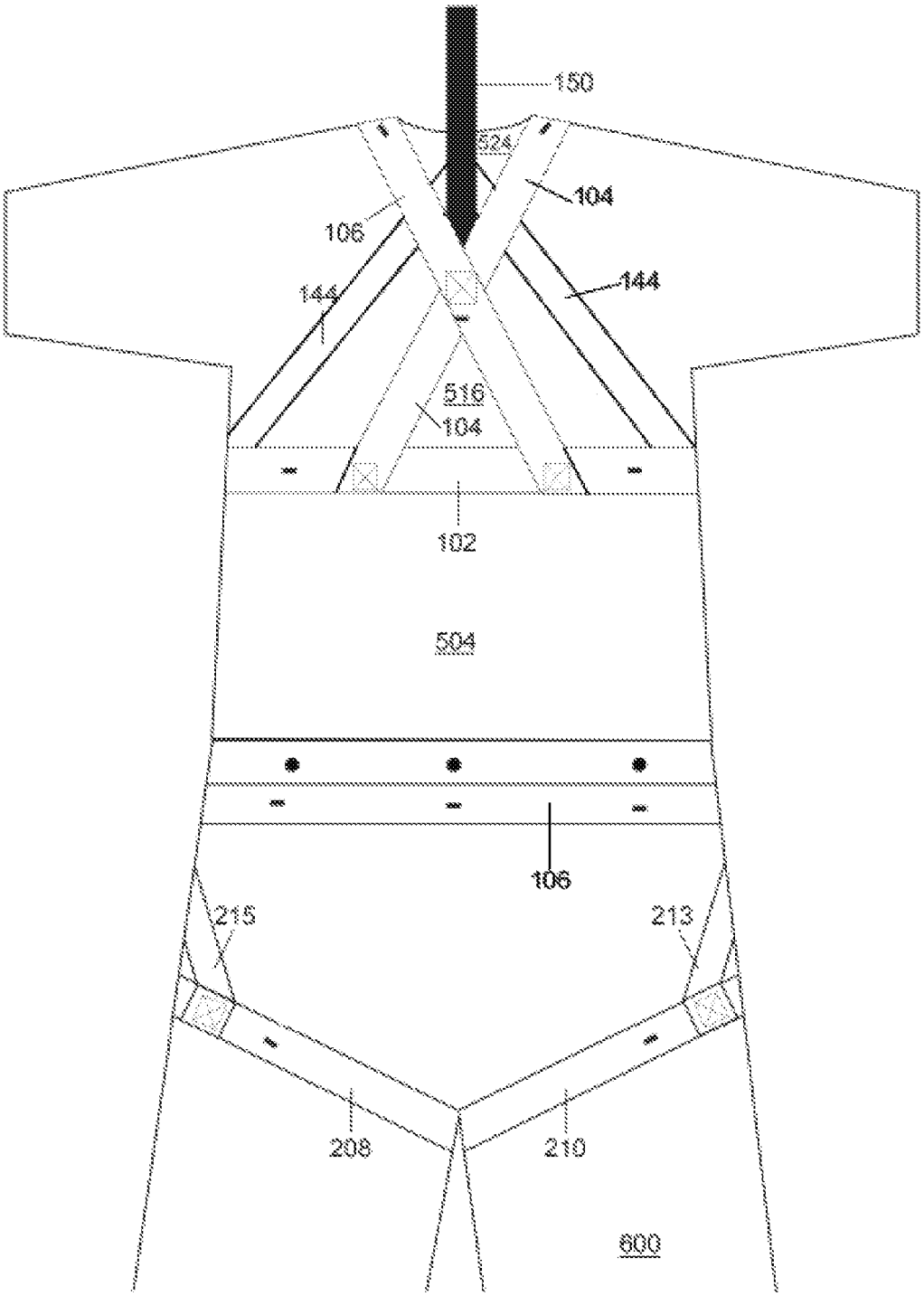
FIG. 4 is a rear view of the vertical lift harness and turnout gear liners shown in FIGS. 2A and 2B, with the upper body harness positioned as if a user were being lifted or dragged by the drag line; and, FIG. 5 is an additional frontal view of the turnout gear liners and vertical lift harness shown in FIGS. 1A and 2A.

Attention is now directed to FIG. 4, which depicts a rear view of the vertical lift harness H and turnout gear liners 500, 600 shown in FIGS. 2A and 2B, with the upper body harness 100 positioned as if a user were being lifted or dragged by the drag line 150. The immediate reaction of such an action is that the drag line 150 pulls the drag line support strap 144 upward sharply toward the back neck area 524 of the user. This puts tension on the buckles 224, 226 connecting the upper body harness 100 to the lower body harness 200, transmitting loads through the buckles down to belt 202, therefore engaging front right vertical connector member 212, front left vertical connector member 214, rear right vertical connector member 213, and rear left vertical connector member 215 to therefore pull on leg loops 208, 210, creating a cradle action and lifting a user primarily from the hips, seat, and leg combination. By interaction of these components, and that drag line 150 is placed between vertical support straps 104, 106 and the user himself, the user is steadied vertically while being lifted by the drag line and harness.

To achieve this function, drag line support strap 144 should be of an appropriate length, generally less than that which would cause it to protrude from the turnout coat through the slot at neck area 524, but long enough to move from the position shown in FIG. 2A to the position shown in FIG. 4. This length will vary depending on the size of the harness.

With the arrangement of the present invention, pressure is spread through the hips, seat, and leg combination and the harness H remains very comfortable even in prolonged lifting use. In prior art systems incorporating a rear dorsal ring, lifting of a user is achieved at an angle, thus the user must strain his/her back to enter a vertical orientation. Not only is this difficult for a conscious user, but it is impossible for an unconscious user.

It will also be appreciated that when two firefighters are wearing the inventive harness H, the first may connect the drag line of the second to the D-ring of the first, typically with a carabiner. Thus, when the first firefighter is lifted his D-ring will pull on the drag line of the second firefighter, pulling or lowering him/her to safety, both in a vertical orientation.

In terms of sizing, it will be appreciated that the various components may be sized in the conventional manner appropriate for clothing and safety harnesses. In this regard, the inventive harness may also be provided with adjustment means such that its various components, or certain of the components, may be size adjusted to fit a variety of individuals.

It will also be noted that without the upper body harness 100, the lower body harness 200 alone acts as a Class II harness. Thus the lower body harness 200 may be used for safety even when the turnout coat is not worn, for example in non-fire rescue situations. Likewise, the upper body harness 100 alone, without the lower body harness 200, functions as an effective drag line in situations where a firefighter might use his turnout coat but, for whatever reason, not have a harness built into the bunker pants. Thus the inventive harness can satisfy three functions, a full Class III harness, a Class II harness, or a drag line harness.

In addition to use by firefighters, the inventive harness may be used by police, S.W.A.T., military, those seeking recreation, boating use, construction use, etc.

Figure 5:
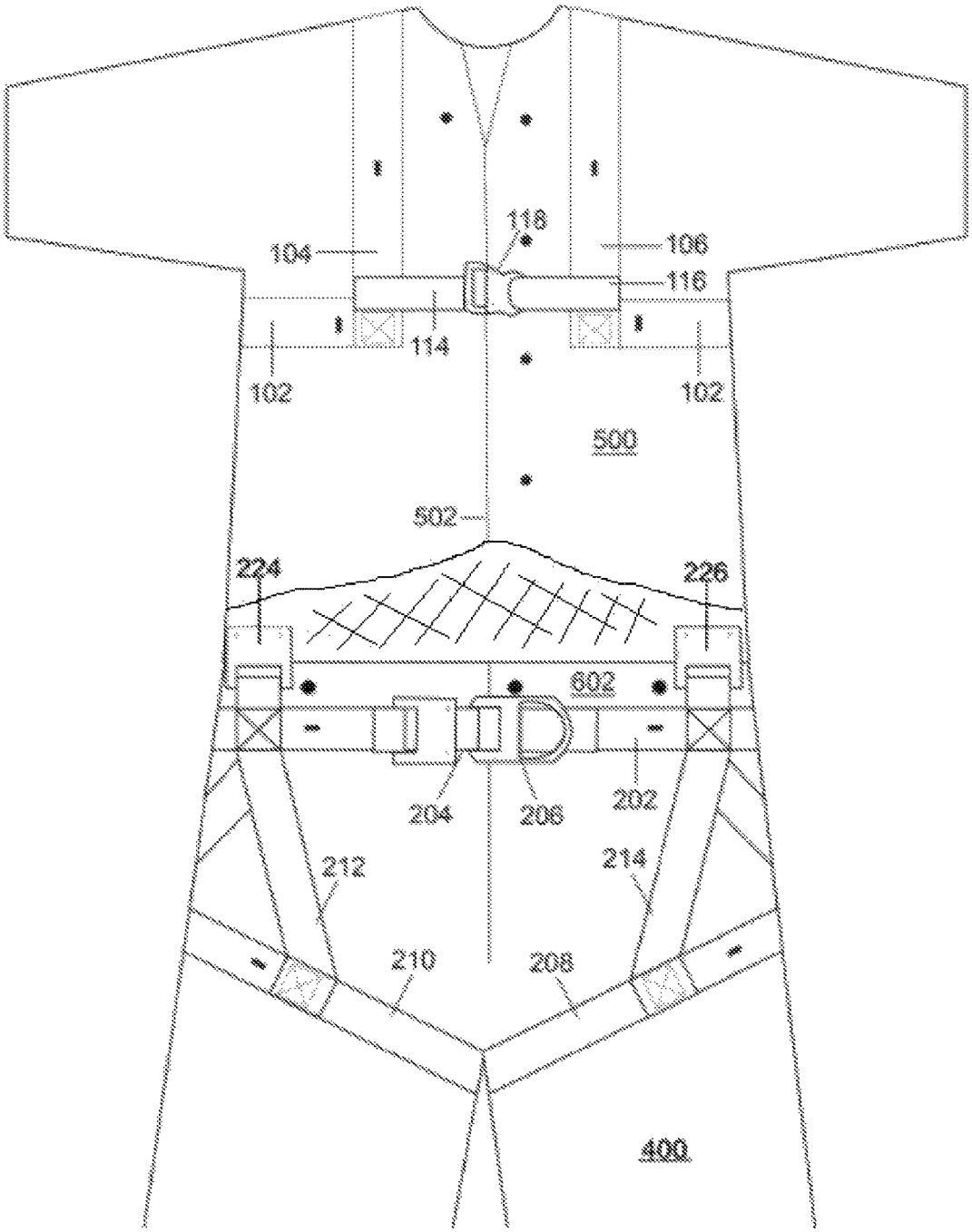

FIG. 5 is an additional frontal view of the turnout gear liners and vertical lift harness shown in FIGS. 1A and 2A.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

I claim:

1. A safety harness for vertically lifting a user, the safety harness comprising:

an upper body harness having a horizontal strap adapted to extend around the torso of a user such that a rear portion of said horizontal strap is adapted to be fitted at the back of the user and a front portion of said horizontal strap is adapted to be fitted at the front of the user with respective left and right side portions adapted to be fitted at the user's left and right sides;

a first vertical strap adapted to extend from said rear portion of said horizontal strap toward a second shoulder of the user;

a second vertical strap adapted to extend from said rear portion of said horizontal strap toward a second shoulder of the user;

a drag line support strap adapted to extend between said left side portion and said right side portion along the back of the user, said drag line support strap being fixedly attached only to said horizontal strap;

a drag line having a first end associated with said drag line support strap and a free second end; and a lower body harness connected to said upper body harness at said left and right side portions;

wherein vertical lifting of said drag line free end pulls said drag line support strap upward to engage the lower body harness and place the user in a vertical orientation, and wherein said first end of said drag line is free to move along at least a portion of said drag line support strap.

2. The safety harness of claim 1, wherein said first vertical strap and said second vertical strap are configured to cross each other in the back area of the user and said drag line support strap is positioned between said first vertical strap and said second vertical strap in said back area.

3. The safety harness of claim 1, wherein said lower body harness is connected to said upper body harness by removable connections.

4. The safety harness of claim 3, wherein said upper body harness alone acts as a drag line harness, said lower body harness alone acts as a Class II harness, and wherein said upper body harness and said lower body harness together act as a Class III harness.

5. The safety harness of claim 1, further comprising a firefighter turnout coat and bunker pants, wherein said safety harness is integral to said turnout coat and bunker pants.

6. The safety harness of claim 5, wherein said turnout coat and bunker pants include a turnout coat liner and bunker pants liner, and wherein a majority of said upper body harness is positioned between said turnout coat liner and said turnout coat and a majority of said lower body harness is positioned between said bunker pants liner and said bunker pants.

7. The safety harness of claim 6, wherein said upper body harness is removeably attached to said turnout coat liner in a plurality of locations and said lower body safety harness is removeably attached to said bunker pants liner in a plurality of locations.

8. The safety harness of claim 6, wherein said turnout coat liner comprises first and second slots to permit portions of the upper body harness to extend there through, said bunker pants comprise third and fourth slots to permit portions of the lower body harness to extend there through, and said turnout coat comprises a fifth slot to permit portions of said drag line to extend there through.

9. The safety harness of claim 8, wherein the portion of said upper body harness extending through said first and second slots includes portions connected to said lower body harness, and said connections are detachable connections.

10. The safety harness of claim 1, wherein said lower body harness comprises a belt with a buckle and a D-ring, wherein said buckle is adapted to be positioned toward either said right or said left side of a user and said D-ring is adapted to be positioned along the vertical centerline of the user.

11. A safety harness for lifting a user, the safety harness comprising:

an upper body harness having a horizontal strap adapted to extend around the torso of a user such that a rear portion of said horizontal strap is adapted to be fitted at the back of the user and a front portion of said horizontal strap is adapted to be fitted at the front of the use with respective left and right side portions adapted to be fitted at the user's left and right sides;

a first vertical strap adapted to extend from said rear portion of said horizontal strap toward a first shoulder of the user;

a second vertical strap adapted to extend from said rear portion of said horizontal strap toward a second shoulder of the user;

a drag line support strap adapted to extend from said left side portion to said right side portion along the back of the user, the drag line support strap being fixedly engaged only with said left side portion and said right side portion; and a drag line having a first end associated with said drag line support strap and a free second end;

wherein said upper body harness is connectable to a lower body harness; and wherein tension on said drag line free second end pulls said drag line support strap.

12. the safety harness of claim 11, wherein said first vertical strap and said second vertical strap are adapted to cross each other in the back area of the user and said drag line support strap is positioned between said first vertical strap and said second vertical strap in said back area.

13. The safety harness of claim 12, wherein said first end of said drag line is free to move along at least a portion of said drag line support strap.

14. The safety harness of claim 11, wherein said upper body harness is connectable to the lower body harness via removable connections.

15. The safety harness of claim 11, further comprising a lower body harness.

16. The safety harness of claim 11, further comprising a firefighter turnout coat, wherein said safety harness is integral to said turnout coat.

17. The safety harness of claim 16, further comprising a lower body harness and turnout pants, said lower body harness being integral to said turnout pants.

18. The safety harness of claim 11, further comprising an article of clothing, wherein said safety harness is associated with said article of clothing.

19. The safety harness of claim 18, further comprising a lower body harness and a second article of clothing, wherein said lower body harness is associated with said second article of clothing.

20. A safety harness for vertically lifting a user, the safety harness comprising:

an upper body harness having a horizontal strap adapted to extend around the torso of a user such that a rear portion of said horizontal strap is adapted to be fitted at the back of the user and a front portion of said horizontal strap is adapted to be fitted at the front of the user with respective left and right side portions adapted to be fitted at the user's left and right sides;

a first vertical strap adapted to extend from said rear portion of said horizontal strap toward a first shoulder of the user;

a second vertical strap adapted to extend from said rear portion of said horizontal strap toward a second shoulder of the user;

a drag line support strap adapted to extend between said left side portion and said right side portion along the back of the user;

a drag line having a first end associated with said drag line support strap and a free second end; and a lower body harness connected to said upper body harness at said left and right side portions;

wherein vertical lifting of said drag line free end pulls said drag line support strap upward to engage the lower body harness and place the user in a vertical orientation;

the safety harness further comprising a coat and pants, wherein said safety harness is integral to said coat and pants;

wherein said coat and pants include a coat liner and pants liner, and wherein a majority of said upper body harness is positioned between said coat liner and said coat and a majority of said lower body harness is positioned between said pants liner and said pants;

wherein said coat liner comprises first and second slots to permit portions of the upper body harness to extend there through, said pants comprise third and fourth slots to permit portions of the lower body harness to extend there through, and said coat comprises a fifth slot to permit portions of said drag line to extend there through.

21. The safety harness of claim 20, wherein the portion of said upper body harness extending through said first and second slots includes portions connected to said lower body harness, and said connections are detachable connections.

* * * * *